United States Patent [19]

Steiniger et al.

[11] Patent Number: 4,484,589

[45] Date of Patent: Nov. 27, 1984

[54] DISTRIBUTOR FOR A ROD MAKING MACHINE FOR THE PRODUCTION OF SMOKERS' ARTICLES

[75] Inventors: Wolfgang Steiniger, Börnsen; Dietrich Bardenhagen, Hamburg; Guido Quarella, Escheburg, all of Fed. Rep. of Germany

[73] Assignee: Hauni-Werke Körber & Co. K.G., Hamburg, Fed. Rep. of Germany

[21] Appl. No.: 392,776

[22] Filed: Jun. 28, 1982

[30] Foreign Application Priority Data

Nov. 20, 1981 [DE] Fed. Rep. of Germany ..... 3145989

[51] Int. Cl.[3] ..... A24C 5/39

[52] U.S. Cl. ..... 131/110; 131/109 R

[58] Field of Search ..... 131/110, 109 R, 109 B, 131/109 AB

[56] References Cited

U.S. PATENT DOCUMENTS 4,185,644 1/1980 Heitmann et al. ..... 131/109 R

*Primary Examiner*—V. Millin

*Attorney, Agent, or Firm*—Peter K. Kontler

[57] ABSTRACT

The invention relates to a distributor in a rod making machine for the production of smokers' articles. It includes an accelerating drum adapted to propel tobacco into a rod conveyor in order to build the tobacco filler. Blown air is utilized to transport the tobacco, particularly to sift the tobacco being sucked up through the air suction bores in the shell of the accelerating drum and through its hollow core which constitutes a suction chamber.

9 Claims, 1 Drawing Figure

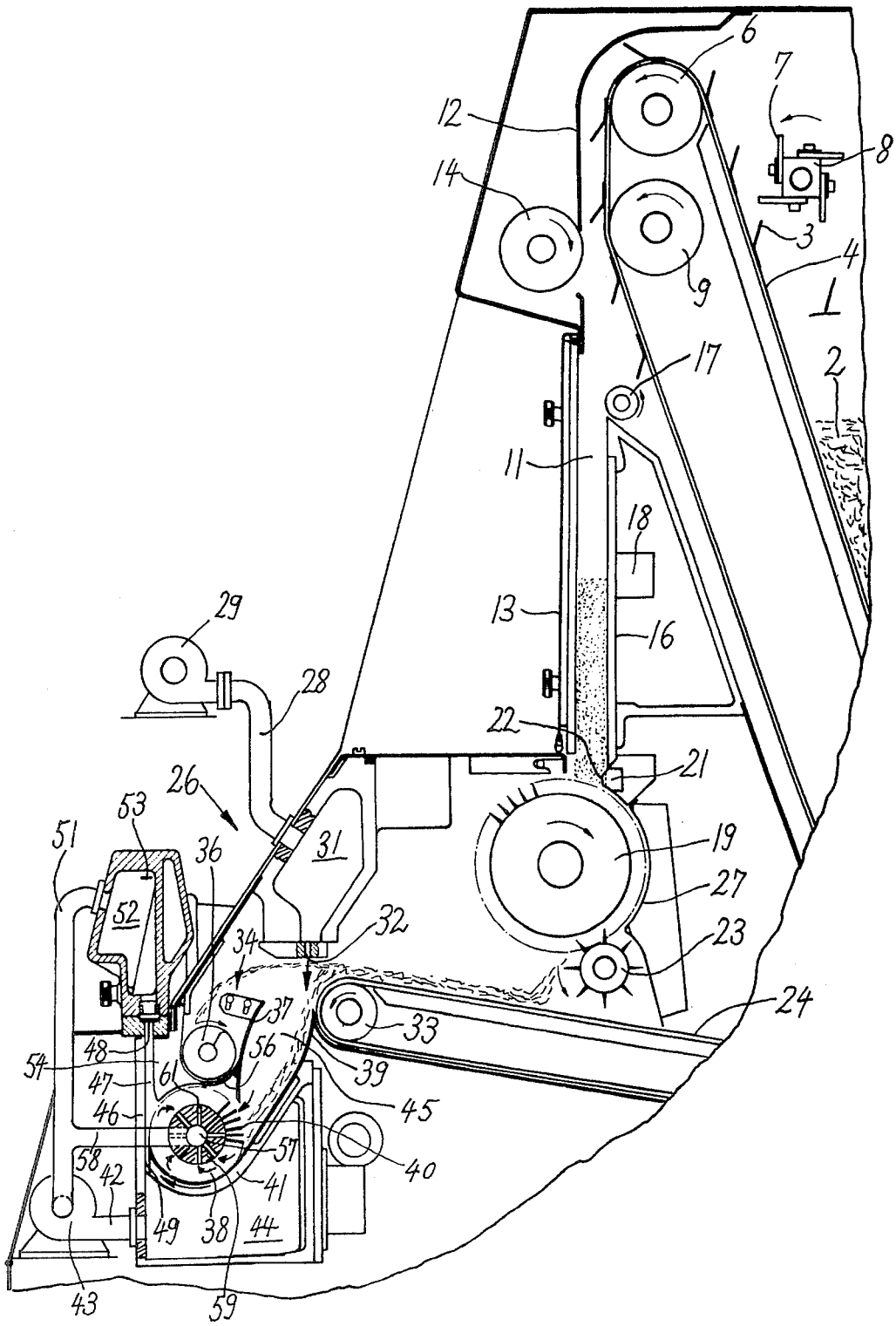
6
7
12
8
14
3
4
9
1
17
2
11
18
29
13
16
28
22
21
26
53
51
36
31
19
27
52
32
23
34
24
37
33
48
56
54
61
39
47
45
46
57
40
58
42
41
49
38
44
43
59

DISTRIBUTOR FOR A ROD MAKING MACHINE FOR THE PRODUCTION OF SMOKERS' ARTICLES

SUMMARY

The invention relates to a distributor of a rod making machine for the production of smokers' articles which is provided with an accelerating drum to propel tobacco upwardly onto a rod conveyor in order to build the tobacco filler, the blowing air which is additionally relied upon to transport resp. especially to sift the tobacco being sucked away through air withdrawing bores (61) in the shell (59) of the accelerating drum (38) and through its hollow core which constitutes a suction chamber (57).

BACKGROUND OF THE INVENTION

The invention relates to a distributor of a rod making machine for the production of rod-shaped smokers' articles. More specifically, it relates to such a distributor which includes an accelerating drum which transfers tobacco onto a suction-rod conveyor and is acted upon by flowing air.

In the abovementioned distributor of a rod making machine, tobacco is subjected to an intensive preliminary treatment preparatory to the building of the rod by being withdrawn from a supply and spread out to form a relatively thin sliver. Thereupon the ribs and other useless particles are removed forming a substantially uniform tobacco stream which is showered onto a tobacco band which operates with suction air. The tobacco filler, which is wrapped into paper, is formed from the tobacco stream in the rod making machine proper. Some of these preliminary steps are carried out by utilizing substantial quantities of air in the form of conveying air and sifting air which, in order to maintain a balanced amount of air in the system, must be withdrawn in time which can take place, for example, in a manner as disclosed in U.S. Pat. No. 4,175,570 by withdrawing the surplus quantities of air through openings in the channel wall as well as through the tobacco band. However, the through-passage, of air in such arrangements is limited, since the air bores can become contaminated and clogged causing the sum of sifting air and conveying air to exceed the quantity of air which is sucked through the tobacco band.

OBJECTS AND SUMMARY OF THE INVENTION

An object of the invention is to provide apparatus adapted to withdraw relatively large quantities of air in order to maintain a balanced amount of air and to preclude disturbing influences of conveying air which are caused by flow pressure and which could interfere with an orderly buildup of the filler.

In accordance with the invention, this object is accomplished by providing a hollow accelerating drum with openings which extend through its shell and communicate with an internal suction chamber of the hollow drum.

In accordance with an advantageous embodiment, the openings constitute air withdrawing bores.

A preferred application of the invention is in a distributor with a sifting duct which faces the accelerating drum and is supplied with blowing air by a sifting device, and with a tobacco channel which is tangential to the accelerating drum and is supplied with blowing air by a transporting device. In such an arrangement, provided in accordance with an advantageous embodiment, the air withdrawing bores of the accelerating drum connect its suction chamber with the sifting duct so that the major part of sifting air is withdrawn through the accelerating drum.

The accelerating drum is preferably provided with air withdrawing bores which extend radially through its shell and are uniformly distributed along its periphery. In this manner, the central suction chamber of the accelerating drum is always connected with the sifting duct.

In accordance with a specific structural development, the periphery of the accelerating drum is provided with pins and the inlet openings of the air withdrawing bores are disposed between the pins.

In accordance with a structural further development, the suction chamber extends centrally and longitudinally axially through the accelerating drum, and the source of suction air is preferably connected with the suction chamber at one end of the accelerating drum.

The advantage which is achieved with the invention consists in that the relatively large periphery of such an accelerating drum is provided with a substantial number of inlet openings for surplus quantities of air and, furthermore, the openings are held free of tobacco by a form of self-cleaning effect as a result of centrifugal force of the rotary accelerating drum so that a clogging of the air withdrawing bores is prevented and the entire cross-sectional area for withdrawal of air is available at all times. In this manner, very large quantities of air can be utilised for preparation or sifting of tabacco and are withdrawn again in order to maintain a balanced amount of air.

The invention will now be described in greater detail with reference to an embodiment which is illustrated in the drawing.

BRIEF DESCRIPTION OF THE DRAWING

The FIGURE is a fragmentary elevational view of distributor in a cigarette rod making machine, with the sidewall removed.

DETAILED DESCRIPTION OF THE PREFERRED EMBODIMENT

The distributor comprises a magazine 1 for a supply 2 of tobacco from which the tobacco is withdrawn by a steep conveyor 4 having entraining elements 3. The upwardly transporting reach of the steep conveyor 4 cooperates with a paddle wheel 8 which is provided with leather straps 7 which is disposed below an upper guide roll 6, and which is connected with the guide roll 6 by a belt drive, not visible. Paddle wheel 8 is adopted to remove the surplus of tobacco from the entraining elements 3 of the steep conveyor 4. A deflecting roll 9, which is located below the guide roll 6, effects a vertical guidance of the downwardly moving reach of the steep conveyor 4 at a level above a storage duct 11. A guide wall 12, which extends in parallelism with said reach and whose curvature in the region of the guide roll 6 conforms to the curvature of such roll, constitutes an extension of a front wall 13 of the storage duct 11 and serves to ensure interference-free guidance of tobacco which descends into the storage duct 11 from the entraining elements 3 of the steep conveyor 4. The guide wall 12 has a cutout for a rotary magnetic roll 14. The suspension of tobacco strands at the upper end of a rear wall 16 of the storage duct 11 is prevented by a roll 17 which is installed at such location and can be driven at a constant RPM.

A monitoring device 18 is provided comprising several reflection type photocells which are distributed across the width of the storage duct 11 at different levels and are electrically connected with one another to transmit signals through time-delay elements only when they are respectively covered for predetermined intervals of time. Monitoring device 18 is mounted on the rear wall 16 of the storage duct 11 and controls a non-illustrated drive for the steep conveyor 4.

The storage duct 11 discharges into a withdrawing conveyor in the form of a carded drum 19 at a 1 o'clock position. Storage duct 11 can be driven by the main drive motor of the rod making machine in a clockwise direction through the medium of a non-visible infinitely variable transmission.

Uniform filling of the carded drum 19 with tobacco from the storage duct 11 is ensured by a strip 21 which oscillates transversely of the carded drum 19, which is adapted to be driven in synchronism with the carded drum, which is disposed between the carded drum and the rear wall 16, and which includes a profiled projection 22 extending into the storage duct 11.

At the 5 o'clock position, the carded drum 19 cooperates with a picker roller 23 which is driven in a counterclockwise direction at a constant RPM and which is installed above an apron conveyor 24 which can be driven at a constant speed in a direction toward a sifting device 26. Portions of the peripheries of the carded drum 19 and picker roller 23 are covered by a shell 27 which extends downwardly all the way to the apron conveyor 24. It prevents, on the one hand, the tobacco from falling out of the carded drum 19 prior to reaching the picker roller 23 and, on the other hand, it intercepts tobacco which is propelled by the picker roller 23 counter to the direction of transport of the apron conveyor 24. The apron conveyor 24 is provided with a profiled rubber coating which ensures substantially slip-free entrainment and transport of tobacco through the sifting device 26.

The sifting device 26 comprises a plenum chamber 31 which is connected to the pressure side of a blower 29 by a conduit 28 and from which issues a directed air curtain through a row of closely adjacent rectangular openings 32, the air curtain flowing transversely of the trajectory of tobacco which leaves the apron conveyor 24 at a deflecting roll 33. An intercepting receptacle 34 with a feed screw 36 at its bottom, serves to intercept heavy tobacco parts (ribs) which are not deflected, or which are only slightly deflected, by the air curtain. The height of the wall 37 between the deflecting roll 33 and the intercepting receptacle 34 is adjustable so that it can influence the sifting action of the sifting device 26.

The wall 37 is curved in such a way that the tobacco particles which impinge thereagainst slide therealong and reach an accelerating drum 38 which rotates in a clockwise direction, which is provided with pins 40, which is adapted to be driven at a constant RPM and which defines with a wall 39 a sifting duct 45 for interception of tobacco which is deflected from its original trajectory by the air curtain. The lower portion of the accelerating drum 38 is surrounded by a wall 41 forming part of a compressed-air chamber 42 which is connected with the pressure side of a blower 43 by a compressed-air conduit 44. In the region in which it merges tangentially into a wall 46 of a tobacco channel 47, the compressed-air chamber is provided with air channels 49 inclined in the direction of transport of an air-permeable belt conveyor 41 which bounds the tobacco channel 47 from above. (This is described in greater detail in applicant's earlier issued U.S. Pat. No. 4,175,570). The rod-transporting belt conveyor 48 is supported by metallic or ceramic pins 53 in a suction chamber 52 which is connected to the suction side of the blower 43 by a suction line 51.

A wall 54 of the tobacco channel 47, which is located opposite the wall 46, covers the accelerating drum 38 from above. The wall 54 further constitutes a bottom for the feed screw 36 and is formed with holes which are provided in a region close to the wall 37 and constitute a sieve 56.

The accelerating drum 38 constitutes a hollow drum and its hollow core constitutes a suction chamber 57 which extends centrally from the one to the other end of the accelerating drum 38. The suction chamber 57 is connected, on the one hand, with the suction side of the blower 43 by a suction line 58 and is connected on the other hand, by openings in the form of air-withdrawing bores 61 extending radially of and uniformly distributed along the periphery of the shell 59 of the accelerating drum 38, with chambers in the form of the tobacco channel 47 and sifting duct 45 which are tangential to the periphery of the accelerating drum 38.

The openings of the air withdrawing bores 61 are provided in the surface of the shell 59 of the accelerating drum 38 between the pins 40.

The mode of operation of the distributor is as follows:

The steep conveyor 4 continuously draws tobacco from the tobacco supply 2 whereby the entraining elements 3 engage relatively small batches of tobacco. Such tobacco batches are made uniform by the paddle wheel 8 in that the tobacco which extends beyond the entraining elements 3 is brushed away by the leather straps 7 of the paddle wheel 8. Tobacco descends from the entraining elements 3 of the steep conveyor 4 between the deflecting rolls 6 and 9 whereby the vertical guide means of the steep conveyor which is provided in this region ensures complete escape of tobacco. The guide wall 12 directs tobacco which is propelled thereagainst centrally into the storage duct 11 whereby the magnetic roll 14 segregates iron particles which might be contained in tobacco. The monitoring device 18 monitors the level of tobacco in the storage duct 11 and regulates the steep conveyor 4 in a sense to maintain the tobacco level at a constant value. Depending on the number of photocells which are covered by tobacco, the RPM of the drive for the steep conveyor 4 is regulated in stepwise fashion. The carded drum 19 is filled with tobacco at the outlet of the storage duct 11, whereby the profiled projection 22 of the oscillating smoothing strip 21 ensures uniform filling of the carded drum 19 on the one hand, in that it introduces tobacco between the pins of the carded drum 19 and, on the other hand, it maintains tobacco in the lower region of the storage duct in continuous motion so it can readily slide down.

During transport to the picker roller 23, the shell 27 prevents escape of tobacco from the carded drum 19 and, if necessary, this shell 27 can terminate in a conventional comb which is disposed in the inlet region of the picker roller 23. The picker roller 23 expels tobacco from the pins of the carded drum 19 and propels it onto the apron conveyor 24. As a rule, longer tobacco shreads remain suspended on the pins of the picker roller 23 for a somewhat longer interval of time so that they reach the apron conveyor 24 ahead of smaller tobacco particles which, as will be described below, is of advantage for the next-following sifting operation. The shell 27, which extends downwardly all the way to the apron conveyor 24, intercepts tobacco shreads which are propelled too far in the rearward direction.

The tobacco carpet which is formed on the apron conveyor 24 is propelled into the sifting device 26 at a predetermined speed whereby the particles of tobacco enter the range of the air curtain which issues from the openings 32. Heavier tobacco particles i.e. (larger particles of ribs) pass through the air curtain and reach the intercepting receptacle 34. As regards the sifting operation, it is preferred that the longer tobacco shreads be located in the lower part of the tobacco carpet so that they do not interfere with the propulsion of heavy tobacco particles thereabove into the intercepting receptacle 34. The air streams issuing from the openings 32 deflect all other tobacco particles from their trajectory to a greater or lesser extent, and such tobacco particles enter the sifting duct 45 which is formed by the walls 37 and 39 and wherein the particles of tobacco are engaged by the accelerating drum 38 and propelled into the tobacco channel 47. The wall 39 is designed in such a way that the streams of air issuing from the openings 32 impinge against it at an acute angle and flow therealong to the accelerating drum 38 so that they reach the tobacco channel 47 without the formation of eddies.

Heavy tobacco particles, which are propelled into the intercepting receptacle 34, are transported away by the rib feed screw 36 whereby the useful particles, e.g., short ribs known as "birds' eyes" can fall through that portion of the wall 54 which constitutes the sieve 56 to reach the accelerating drum 38.

On entry into the tobacco channel 47, tobacco is entrained by air streams which issue from the air channels 49, which flow in the direction of transport of the rod conveyor 48, and which impart to the tobacco a component of movement in the direction of transport of the rod conveyor 48 so that, on impinging upon the rod conveyor band 48 or upon tobacco which already adheres thereto, the tobacco undergoes negligible acceleration in such direction. The major part of the sifting air which flows from the openings 32 is sucked away through the air-withdrawing bores 61 of the accelerating drum 38. The remainder of the sifting air which reaches the tobacco channel 47 is sucked through the rod conveyor belt 48 and into the suction chamber 52, together with air which is admitted through the air channels 49, such air also serving to hold the tobacco on the rod conveyor band. In this manner, one ensures the presence of balanced amounts of air in the corresponding region of the distributor.

I claim:

1. In a machine for the production of cigarettes or analogous rod-shaped smokers' articles having fillers of tobacco or other particulate material, a distributor comprising a source of particulate material; a rotary drum-shaped accelerating conveyor defining an internal suction chamber and having openings connecting said suction chamber with the surrounding atmosphere, said conveyor being spaced apart from said source; pneumatic conveyor means for delivering to said accelerating conveyor particulate material from said source in a gaseous carrier medium whereby the accelerating conveyor segregates at least a substantial percentage of the gaseous carrier medium from particulate material by drawing the carrier medium into said chamber via said openings and propels the segregated particulate material in a predetermined direction; and a stream forming conveyor arranged to receive the propelled particulate material.

2. The distributor of claim 1, wherein said pneumatic conveyor means comprises a sifting duct adjacent to the periphery of said accelerating conveyor.

3. The distributor of claim 1, wherein said openings are at least substantially uniformly distributed in the periphery of said accelerating conveyor.

4. The distributor of claim 1, wherein said accelerating conveyor comprises a hollow shell surrounding said suction chamber and provided with said openings, and pins extending outwardly from said shell to hold particulate material away from said openings.

5. The distributor of claim 1, wherein said chamber extends centrally and axially of said accelerating conveyor.

6. The distributor of claim 1, further comprising a suction generating device and conduit means connecting said suction generating device with said suction chamber at one axial end of said accelerating conveyor.

7. The distributor of claim 1, further comprising means for classifying particulate material which is supplied by said pneumatic conveyor means, said classifying means including a receptacle having a perforated wall adjacent to said accelerating conveyor, said receptacle being arranged to gather certain constituents of classified particulate material and said pneumatic conveyor being arranged to withdraw from said receptacle by suction those constituents of classified particulate material which can pass through said perforated wall.

8. The distributor of claim 1, wherein said pneumatic conveyor means includes a guide wall having an arcuate section spacedly surrounding a portion of said accelerating conveyor.

9. The distributor of claim 1, further comprising means defining at least one channel for reception of particulate material from said accelerating conveyor, said stream forming conveyor having a portion extending transversely of and receiving particulate material from said channel.

* * * * *